United States Patent [19]

Kennedy et al.

[11] Patent Number: 4,892,017

[45] Date of Patent: Jan. 9, 1990

[54] AUTOMOTIVE FUEL SYSTEM ADJUSTMENT TOOL

[76] Inventors: T. W. Kennedy, 13145 Woodmont Pl., Poway, Calif. 92064; James C. McMillen, 1498 Country Club Dr., Escondido, Calif. 92025

[21] Appl. No.: 334,478

[22] Filed: Apr. 7, 1989

[51] Int. Cl.[4] ..... B25B 7/02

[52] U.S. Cl. ..... 81/492; 81/177.6; 81/57.29

[58] Field of Search ..... 81/429, 177.2, 177.6, 81/177.1, 53.11, 53.1, 57.29, DIG. 5

[56] References Cited

U.S. PATENT DOCUMENTS

| | | | |
|---|---|---|---|
| 1,199,823 | 10/1916 | Sadtler | 81/57.29 |
| 2,814,322 | 11/1957 | Kupfrian | 81/177.6 |
| 4,515,043 | 5/1985 | Gray | 81/57.29 |

*Primary Examiner*—Robert P. Olszewski
*Assistant Examiner*—Lawrence Cruz
*Attorney, Agent, or Firm*—Gregory O. Garmong

[57] ABSTRACT

A fuel system adjustment tool includes an elongated shaft and a rotatable rod disposed within the shaft. At one end of the rod is a drive that operably fits to an adjustment point on a carburetor. At the other end is a rotatable knob that produces a tactile engagement or clicking sensation at selected degrees of rotation, preferably every 180 degrees of rotation. The engagement is produced by a collar having a notch therein on the end of the shaft, and spring loaded balls in recesses on the interior of the knob. As the knob is rotated, one of the balls falls into the notch at the selected degree of rotation, but is releasable from the notch upon further rotation.

13 Claims, 2 Drawing Sheets

AUTOMOTIVE FUEL SYSTEM ADJUSTMENT TOOL

BACKGROUND OF THE INVENTION

This invention relates to tools used to adjust fuel systems on vehicles, and, more particularly, to a tool that provides to the mechanic a direct indication of the degree of adjustment.

Carburetors, fuel injectors, and other types of fuel system devices (termed generally "carburetors" herein) are found in automobiles and trucks to mix fuel with air in a controlled manner. The mixture flows from the carburetor into the cylinders of the engine, where it is burned to release energy and drive the engine. The operation of the engine therefore depends directly upon maintaining the carburetor in proper adjustment, and carburetor adjustment is a key part of major and minor tuneups.

There are two principal points of adjustment on carburetors and fuel injectors, the mixture adjustment and the idle speed adjustment, and each has an independent adjustment control in the form of a screw that can be rotated clockwise or counterclockwise. In tuning the engine, the mechanic alternatively adjusts these two controls while observing engine performance, to obtain an optimal performance of the engine.

In modern engines, the carburetors are sometimes rather inaccessible to the mechanic, with the result that it may be difficult to adjust the carburetor controls while observing the engine operation. Elongated adjustment tools have been developed to aid in reaching the controls, but the presently available tools are difficult to use. There is therefore a need for an improved carburetor adjustment tool that provides access to the carburetor, yet is easy to use in performing fine adjustments of the carburetor controls. The present invention fulfills this need, and further provides related advantages.

SUMMARY OF THE INVENTION

The present invention provides a carburetor adjustment tool in several different forms that permit access to hard-to-reach carburetor controls. The tool provides an accurate indication of the degree of adjustment of the control through a releasable engagement or clicking of the handle as it is rotated to turn the carburetor control. The mechanic is therefore able to devote his primary attention to the performance and response of the engine to the adjustments, rather than to monitoring the degree of adjustment.

In accordance with the invention, a fuel system adjustment tool comprises an elongated hollow shaft; transmittal means for transmitting a rotational motion from one end of the hollow shaft to the other end, the transmittal means being disposed within, and rotatable within, the hollow shaft; a drive head attached to the transmittal means at one end of the hollow shaft and extending beyond that end of the hollow shaft; a rotatable control knob attached to the transmittal means at the other end of the hollow shaft; and sensing means for creating in the control knob a tactile sensation of releasable engagement at preselected degrees of rotation of the drive head.

The elongated hollow shaft may be straight or curved. If straight, then the transmittal means is normally a single rod rotatable within the shaft. If the shaft is curved, then a flexible coupling such as a length of cable is added to the rod, to transmit the rotational motion around the curve. The drive head is attached to the transmittal means at one end of the shaft, and includes an adapter that fits to the shape required to turn the carburetor control adjustment. The drive head may optionally include a gearbox that permits the rotational movement to be turned through an angle, normally 90 degrees.

The control knob attached to the transmittal means at the other end of the shaft permits the transmittal means, and thence the drive head and adapter, to be controllably rotated. The sensing means provides a tactile sensation of the degree of rotation.

In a preferred approach, the sensing means includes a collar around the outside of the hollow shaft near the end where the knob is attached to the transmittal means. The collar has a notch in it that runs parallel to the elongated direction of the shaft. The control knob is hollow to fit over the end of the shaft and attach to the transmittal means. On the inside circumference of the control knob is at least one, and preferably two, recesses disposed opposite the collar, when the tool is assembled. Each recess is adapted to capture therein a ball that is biased inwardly against the collar, preferably by a circular spring on the outside of the knob that presses against the outwardly facing surface of the ball.

As the knob is turned, each ball rides on the outer surface of the collar, and then falls into and engages the notch when the ball and the notch come into coincidence. With the preferred structure, this engagement is accompanied by a sense of releasable engagement transmitted to the hands of the mechanic through the knob, and an audible sound. The further rotation of the knob is resisted by the inward biasing pressure of the spring that tends to releasably hold the ball in the notch. With the exertion of greater rotational force on the knob, the ball rides upwardly on the sides of the notch against the biasing force, and returns to its rolling motion on the outwardly facing surface of the collar. In the case of a single recess and ball, the knob may be rotated 360 degrees, a full turn, before it again engages the notch. In the preferred case of two recesses and two balls, disposed at 180 degrees from each other around the inner circumference of the knob, the knob may be rotated 180 degrees between each releasable engagement. Most mechanics are trained to think in terms of "half turns" or 180 degrees of rotation when making carburetor adjustments, and therefore the approach with two recesses and two balls is preferred. Of course, other angular engagements can be produced by using more recesses and balls spaced in the appropriate manner around the circumference of the knob.

The carburetor tool of the invention has been found to yield surprisingly improved results when used by mechanics to adjust carburetors, as compared with the prior approach. The mechanic can reach the carburetor adjustments while positioning himself so that he can monitor engine performance, either by listening to the sound of the engine or by viewing instruments, or both. The releasable engagment is directly monitored by the mechanic, who is able to think in terms of numbers of precisely defined half turns, in the case of the preferred embodiment, as he is monitoring the change in performance of the engine as the adjustment is made. It is surprisingly difficult to make accurate half turns and keep track of them, for two different adjustment controls and while attempting to direct the primary attention to the results of the adjustments, in the absence of this positive indication.

The carburetor adjustment tool of the invention therefore provides an advance in the art of automotive tuning, by providing an accurate, controllable, and readily monitored way of adjusting carburetor controls while devoting primary attention to the results of the adjustments rather than the act of adjusting itself.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
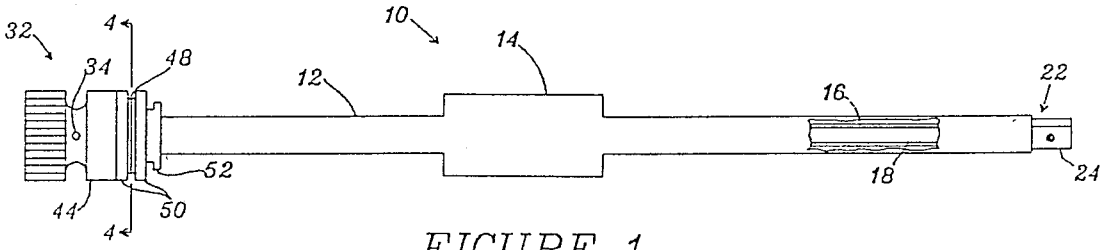
FIG. 1 is a side elevational view of a first embodiment of the invention, with a portion broken away.
Figure 2:
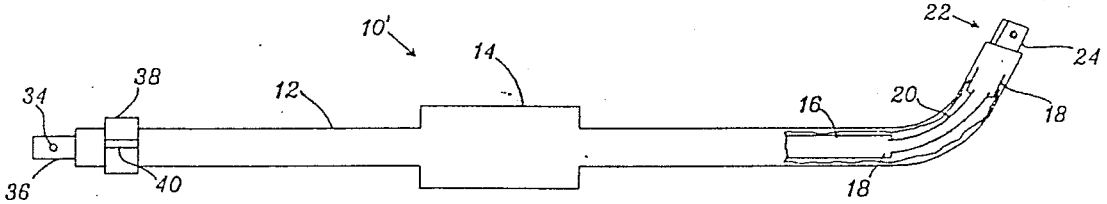
FIG. 2 is a side elevational view of a second embodiment of the invention, with a portion broken away and the control knob removed.
Figure 3:
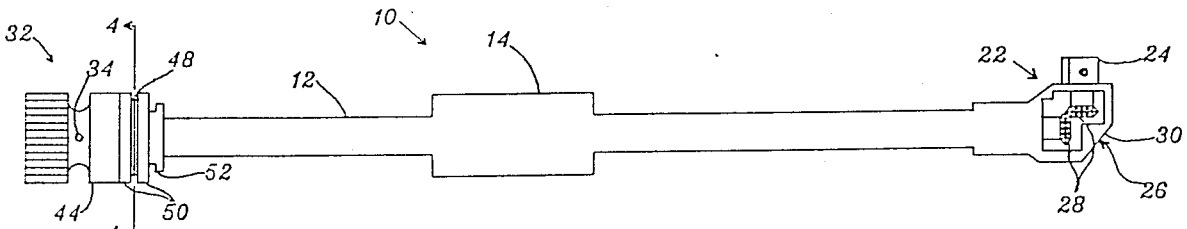
FIG. 3 is a side elevational view of a third embodiment of the invention.

FIGS. 1–3 illustrate three embodiments of a carburetor adjustment tool 10. In each case, the tool 10 includes an elongated hollow shaft 12. Desirably, a plastic handle 14 is molded over the shaft 12 to provide a positive gripping surface for one hand of the mechanic.

Extending through the interior of the hollow shaft 12 is a transmittal means for transmitting a rotational force, preferably a rod 16. In the straight tool 10 of FIG. 1, the rod 16 is a single piece of solid metal 18. In a curved tool 10′ of FIG. 2, the hollow shaft 12 is curved so that the rotational force is delivered at one end of the shaft 12 along a different axis than input at the other end of the shaft 12. In that case, the rod 16 includes an intermediate element that permits the rotational force to be transmitted around the curve of the shaft 12. Preferably, the intermediate element is a piece of flexible cable 20 that is crimped into the ends of the the solid metal pieces 18, the solid metal pieces 18 and the flexible cable 20 together constituting the rod 16 or transmittal means. Speedometer cable has been found satisfactory for use as the flexible cable 20.

Attached to one end of the rod 16 is a drive head 22. As illustrated in FIGS. 1 and 2, the drive head 22 includes at least an adaptor 24 that permits the rotational force of the tool 10 to be delivered to the set screws of the carburetor (not shown). In one approach, the adapter 24 is a ¼ inch socket drive, to which a variety of socket wrenches or screwdriver heads can be attached. The tool 10 is thus made sufficiently versatile that it can be used with virtually any type of carburetor.

FIG. 3 illustrates another type of drive head 22. Here, the rotational force of the tool 10″ is to be delivered at right angles to the axis of the shaft 12. It has been found that the approach of using a flexible cable 20, as shown in FIG. 2, is not readily operable to transmit the rotation through a 90 degree angle. A gearbox 26 is therefore provided on the end of the shaft 12. The gearbox continues two gears 28 adapted to mesh at right angles and supported in a gearbox housing 30. One of the gears 28 is attached to the end of the rod 16, and the other gear 28 is attached to the adapter 24.

The three embodiments of FIGS. 1–3 therefore permit the rotation required for adjusting the carburetor (or other fuel device) controls to be delivered at an angle to the shaft of from 0 to 90 degrees, depending upon the particular requirements and design of the carburetor. In the illustrated form, three separate tools 10 are used, but the same effect can be attained by building interchangeable attachments that fit onto the end of a single shaft, and deliver the rotation in a straight line, an angle of from 0 to 90 degrees to the shaft, or an angle of 90 degrees to the shaft. These attachments would utilize the principles just discussed to attain delivery of the rotation over such a range of angles.

At the other end of the shaft 10, there is a control knob 32 that is grasped by the mechanic to introduce the rotational force into the rod 16 for delivery to the drive head 22 and thence to the carburetor control. The control knob 32 is generally cylindrical, preferably with knurling over at least a portion of its length to aid in gripping. The control knob 32 is hollow, and slides over the end of the shaft 12. It is firmly fixed by a pin 34 driven through a transverse hole through the knob 32 and another transverse hole through the protruding end 36 of the rotatable rod 16, which protrudes from the end of the shaft 12. The turning of the knob 32 therefore causes the rod 16 to turn and rotate within the shaft 12.

The releasable engagement that provides a sensory indication of the extent of rotation is provided by a sensing means that utilizes cooperating elements on the shaft 12 and on the knob 32. A collar 38 is fitted circumferentially around the shaft 12 near its end. The collar 38 has a notch 40 running along its length parallel to the long direction of the shaft 12. The collar is preferably a piece of spring stock having a circumferential length selected to leave a small gap when fitted over the shaft 12, the gap becoming the notch 40.

Figure 4:
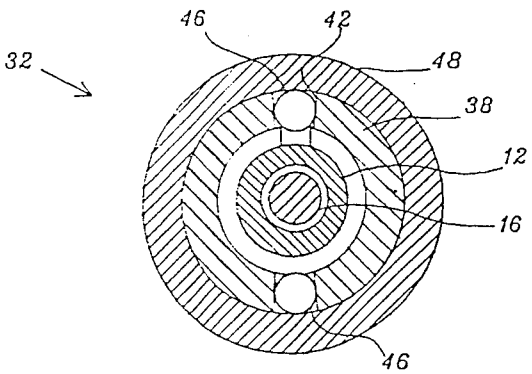
FIG. 4 is a sectional view of a portion of the tool of the invention, taken generally along line 4—4 of FIG. 1.

As illustrated in FIGS. 1 and 4, the control knob 32 includes a pair of recesses 42 through a body 44 of the knob 32. A ball 46 is inserted in each recess 42, and is captured and retained within the recess 42 by a circular spring 48 that extends around the body 44. The spring 48 biases the balls 46 inwardly. The circular spring 48 is held at the proper position along the length of the knob 32 by two retainer rings 50, one on either side of the spring 48. The retainer rings 50 and the spring 48 are in turn locked into their position with a C-shaped retainer spring 52.

The length of the knob 32 and the position of its engagement to the rod 16 by the pin 34 are dimensioned so that the recess 42 is in an overlying and facing relationship to the collar 38. The balls 46 are therefore biased inwardly by the spring 48 to ride upon the face of the collar 38, as the knob 32 is turned to rotate the rod 16 and thence the drive head 22. When one of the balls 46 rotates to a position where it faces the notch 40, it falls radially inwardly into the notch 40 under the biasing force of the spring 48. This movement of the ball 46 produces a tactile sense of a releasable engagement to the hand of the mechanic that is grasping and turning the knob 32, and additionally there is typically some sound produced that is audible to the mechanic. The mechanic is therefore signalled that a reference point in the turning of the carburetor control has been reached.

When the mechanic is ready to make another ½ turn by turning the knob 32 in either direction, he applies sufficient force to the knob 32 to cause the ball 46 to ride radially outwardly on the sides of the notch 40 against the biasing force of the spring 48, and back onto the surface of the collar 38. The engagement of the ball 46 to the notch 40 is thereby released. The knob 32 is freely turned until the next engagement position is reached when the other ball 46 falls into the notch 40. The amount of rotation of the knob 32 is precisely ½ turn from engagement to engagement, in the illustrated embodiment. Of course, other amounts of angular rotation between engagements can be readily achieved by utilizing either less than two or more than two recesses 42, and a ball 46 in each recess, at the desired positions around the circumference of the knob 32.

Normally, the mechanic begins any adjustment with the one of the balls in the releasable engagement position, and then rotates the knob 32 until the next releasable engagement position is reached. With this approach, the amount of rotation will be exactly ½ full turn, or 180 degrees from the last engagement, in the preferred embodiment using two recesses 42 spaced 180 degrees from each other around the circumference of the body 44 of the knob 32, as shown in FIG. 4. There is no guesswork in achieving exactly ½ turn, and there is a positive sensation that the ½ turn has been completed. If the mechanic desires to make multiple ½ turns, he need only count the number of ½ turns required, again without concern for ensuring that each ½ turn is exact. As indicated, it is surprisingly difficult to achieve precise ½ turns and to count multiple ½ turns while maintaining the primary attention on the performance changes of the engine that are produced by the turns, and the tool 10 greatly improves the ability of the mechanic to devote virtually his full attention to the operation of the engine and not to achieving reproducible ½ turns.

The assembly of the tool 10 is readily apparent from the prior description of the various components and elements. All parts are made of steel, except for the plastic handle 14.

The present invention provides a highly useful tool for mechanics, improving their ability to adjust carburetors for optimum performance of the engine. Although a particular embodiment of the invention has been described in detail for purposes of illustration, various modifications may be made without departing from the spirit and scope of the invention. Accordingly, the invention is not to be limited except as by the appended claims.

What is claimed is:

1. A fuel system adjustment tool, comprising:

an elongated hollow shaft;

transmittal means for transmitting a rotational motion from one end of the hollow shaft to the other end, the transmittal means being disposed within, and rotatable within, the hollow shaft;

a drive head attached to the transmittal means at one end of the hollow shaft and extending beyond that end of the hollow shaft;

a rotatable control knob attached to the transmittal means at the other end of the hollow shaft; and sensing means for creating in the control knob a tactile sensation of releasable engagement at preselected degrees of rotation of the drive head.

2. The tool of claim 1, wherein the hollow shaft is straight.

3. The tool of claim 1, wherein the hollow shaft is curved.

4. The tool of claim 1, wherein the transmittal means is a solid rod.

5. The tool of claim 1, wherein the transmittal means includes a solid rod and a length of flexible cable attached to an end of the solid rod.

6. The tool of claim 1, wherein the drive head includes a socket drive.

7. The tool of claim 1, wherein the drive head includes a gearbox that changes the direction of the rotation of the drive head relative to the transmittal means.

8. The tool of claim 1, wherein the sensing means includes a collar on the hollow shaft having a notch therein, and a ball captured within a recess in the control knob at a location so that the ball is rollable on the collar, the ball being spring loaded to fall into the notch on the collar to achieve an engagement at the selected degree of rotation, but releasable from the notch upon further rotation.

9. The tool of claim 8, further including a second recess in the control knob at a location so that the ball is rollable on the collar, and a second all which is spring loaded to fall into the notch on the collar to achieve an engagement at a selected degree of rotation, but releasable from the notch upon further rotation.

10. The tool of claim 9, wherein the two recesses are disposed at 180 degrees from each other around the circumference of the knob, so that a releasable engagement occurs every 180 degrees of rotation of the knob.

11. A fuel system adjustment tool, comprising:

an elongated hollow shaft;

a rod disposed within, and rotatable within, the hollow shaft;

a drive head attached to the rod at one end of the hollow shaft and extending beyond that end of the hollow shaft;

a collar on the hollow shaft having a notch therein;

a rotatable control knob attached to the rod at the other end of the hollow shaft, the knob having two internal recesses therein disposed opposite the collar on the hollow shaft, the two recesses being separated by a distance of 180 degrees around the circumference of the knob; and a ball captured within each of the two recesses of the control knob, each of the balls being spring loaded to fall into the notch on the collar to achieve an engagement at the selected degree of rotation, but releasable from the notch upon further rotation.

12. The tool of claim 11, wherein the rod is a single continuous piece of metal.

13. The tool of claim 11, wherein the rod includes a piece of flexible cable at a location along the length of the rod.

* * * * *